US005669198A

United States Patent [19]

Ruff

[11] Patent Number: 5,669,198

[45] Date of Patent: Sep. 23, 1997

[54] ANCHOR FOR METAL DOOR FRAME

[75] Inventor: Robert O. Ruff, Cincinnati, Ohio

[73] Assignee: Ingersoll-Rand Company, Woodcliff, N.J.

[21] Appl. No.: 537,425

[22] Filed: Oct. 2, 1995

[51] Int. Cl.[6] ..... E06B 1/12

[52] U.S. Cl. ..... 52/656.4; 52/211; 52/213; 52/712; 52/715; 49/504; 248/222.52

[58] Field of Search ..... 52/211, 212, 213, 52/214, 215, 216, 217, 656.2, 656.4, 656.5, 656.6, 656.7, 730.3, 730.5, 730.6, 715, 210, 710, 712, 714; 49/504; 248/248, 222.52

[56] References Cited

U.S. PATENT DOCUMENTS

| | | | |
|---|---|---|---|
| 1,271,210 | 7/1918 | Otte | 52/211 |
| 1,361,586 | 12/1920 | Johnson | 52/211 |
| 2,574,350 | 11/1951 | Peelle . | |
| 2,598,139 | 5/1952 | Shea . | |
| 2,652,907 | 9/1953 | Miller . | |
| 2,676,680 | 4/1954 | Kindorf | 52/710 X |
| 2,700,441 | 1/1955 | Cudini . | |
| 2,900,677 | 8/1959 | Yetter | 52/710 X |
| 3,014,562 | 12/1961 | Schwartzberg . | |
| 3,103,263 | 9/1963 | Leeser . | |
| 3,119,155 | 1/1964 | Schlegel . | |
| 3,350,123 | 10/1967 | Loving et al. . | |
| 3,445,977 | 5/1969 | Latiano . | |
| 3,636,672 | 1/1972 | Fink . | |
| 3,721,055 | 3/1973 | Jerchower . | |
| 3,798,865 | 3/1974 | Curtis | 52/715 X |
| 4,034,513 | 7/1977 | Richardson . | |
| 4,212,445 | 7/1980 | Hagen | 248/222.52 X |
| 4,442,644 | 4/1984 | Jukes . | |
| 4,510,722 | 4/1985 | van Wieringen . | |
| 4,532,744 | 8/1985 | Beneze et al. | 52/710 X |
| 4,637,183 | 1/1987 | Metz . | |
| 4,787,767 | 11/1988 | Wendt | 52/715 X |
| 4,873,804 | 10/1989 | Kukke . | |
| 5,137,389 | 8/1992 | Magoon . | |

FOREIGN PATENT DOCUMENTS

| | | | |
|---|---|---|---|
| 1163255 | 9/1958 | France | 52/213 |
| 348081 | 5/1931 | United Kingdom | 52/213 |
| 853581 | 11/1960 | United Kingdom | 52/710 |

OTHER PUBLICATIONS

Adjustable Brace (Loose Anchor) and Door Frame Assembly Details with Suggested Assembly Procedure, American Buildings Company, Ceco Door Division, Dec. 15, 1989, pp. 7 and 8.

"K. D. Frame Assembly And Installation For Open Steel Stud", No. 2006, Rev. Jul. 1980, Steelcraft.

"Steel Doors, Frame and Entrance Systems", 08100 STC, BuyLine 0020, Steelcraft, pp. 1–7.

"Nomenclature for Steel Doors and Steel Door Frames", ANSI/SDI A123.1–1989, American National Standards Institute, Inc., pp. 1–17.

*Primary Examiner*—Wynn E. Wood
*Assistant Examiner*—Laura A. Saladino
*Attorney, Agent, or Firm*—Steven J. Rosen

[57] ABSTRACT

A metal frame anchor, such as one used for securing a metal door or window frame to an adjacent wall structure, having a generally rectangular base, two prongs bent upward and then over the base in opposite directions to form clips which open in opposite directions, and the base having at least one set of angularly cut opposite corners. The slidably insertable metal frame anchor is typically disposed in a metal frame element such that the anchor's base is positioned on inside surfaces of the backbends with the two prongs bent upward and then over the base in opposite directions to form clips which open in the opposite directions and which are positioned on outside surfaces of the backbends to which the anchor is clipped.

13 Claims, 3 Drawing Sheets

ANCHOR FOR METAL DOOR FRAME

BACKGROUND OF THE INVENTION

1. Field of the invention

The present invention pertains to anchors used on metal frames for doors or other casings and, in particular, to jamb anchor and frame assemblies for metal door and other knock down frames.

2. Description of Related Art

The field of the present invention is the art of metal frames for openings, such as doors in buildings and the invention may also be applied to window frames and casings. This invention relates to anchors which are mounted to hollow sheet metal frames, which can be easily installed by workmen in openings, such as the doorway in a new or an existing wall of a building. Typically simple tools, for example, a hammer, level, a square and screw driver are used for assembly of the frame and its installation. The frames may be delivered to the construction or installation site either assembled or in knockdown condition for field assembly at the job site. More particularly, this invention relates to an anchor used to secure the frame to an adjacent wall structure surrounding an opening in which the frame is disposed. Masonry and wood anchors for securing the frames to surrounding wall and/or flooring are well known and are particularly useful for anchoring door jambs. Examples of such anchors may be found in U.S. Pat. Nos. 2,652,907, 2,574,350 and 4,873,804. Among the draw backs is that the anchors cannot be easily installed and later positioned within the frame elements such as the jambs, header and sill or threshold.

A door anchor disclosed in a brochure from the CECO Door Division (pages 7 and 8) of the American Building Company discloses an anchor which uses bent tabs or prongs which extend away and over a base of the anchor to clip to backbends of the jamb such that the prongs engage inner surfaces of the backbend and the base engage outer surfaces of the backbends. Provisions are made for securing this anchor to the backbends with the use of self tapping screws through predrilled attachment holes in the base and holes in the backbends that are drilled in the field. Such an anchor has several draw backs such as it loads so as to tend to pull away from the backbends it is clipped to and, therefore, its loading is adverse to the use of spot welding instead of screws to secure the anchor to the jamb. It requires more drilling of the jamb at the site which is difficult due to the proximity to the adjacent wall. It requires more materials in the form of self tapping screws that can fit the predrilled attachment holes. It relies solely on the tabs or prongs, which are small and thin, and the screws to take the anchoring loads at their respective points of attachment to the backbends. Sometimes screws cannot be used because of a lack of room to access the slotted screw heads. The base of CECO anchor is on the outside of the backbend and if pressed near the adjacent wall is difficult to position once the installation process is under way.

Therefore, there is a need for a frame anchor and, in particular, a metal door frame anchor which is easy to install, position and secure to backbends of a frame element such as a door jamb. There is also a need for a stronger anchor to backbend fastening method and/or design than is presently available for such an assembly or anchor.

SUMMARY OF THE INVENTION

A metal frame anchor, such as one used for securing a metal door or window frame to an adjacent wall structure, having a generally rectangular base, two prongs bent upward and then over the base in opposite directions to form clips, which open in opposite directions and, at least one set of angularly cut opposite corners of the base. Preferably, the anchor includes a twisting element for turning the base about an axis perpendicular to the base and may be in the form of a slot in the base. The base is preferably formed from a steel plate wherein the prongs are also formed from the steel plate.

The exemplary embodiment of the present invention includes a metal frame assembly having a bent sheet metal frame element encompassing an inner space and having a soffit spaced apart from and generally parallel to a rabbet and a stop extending substantially perpendicular to and between the rabbet and the soffit. The soffit and the rabbet are supported by two faces extending generally perpendicular from and away from the rabbet and the soffit to back ends of the faces; backbends extending perpendicularly inward from the back ends of the faces so as to be generally parallel to the rabbet and soffit and bordering the inner space; and the slidably insertable metal frame anchor disposed in the frame element. The anchor base is positioned on inside surfaces of the backbends with the two prongs bent upward and then over the base in opposite directions to form clips which open in the opposite directions and which are positioned on outside surfaces of the backbends to which the anchor is clipped. The base may be fastened to the backbends such as having the base welded or, more particularly, tack welded to the backbends.

ADVANTAGES

Among the advantages provided by the present invention is a better, stronger, easier to use anchor and metal frame and anchor assembly that is particularly useful for securing door, panel or window frames to adjacent walls. Anchors of the present invention can be easily installed and positioned within frame elements such as the jambs, header and sill or threshold. Another advantage of the present invention is that it tends to pull from inside of the backbends to which it is clipped to and, therefore, it is pulling the backbends and the frame towards the wall and wall structure to which the frame is attached. This facilitates the use of spot welding instead of screws to secure the anchor to the jamb. It also eliminates the requirement of drilling of the jamb at the site which is difficult due to the proximity to the adjacent wall.

The anchor and the anchor and frame assembly of the present has the advantages of being easier to install and position, providing a stronger fastening of the anchor to backbends of the frame element, and providing easier attachment of the anchor to the backbend than the anchor and frame and anchor assemblies presently available.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
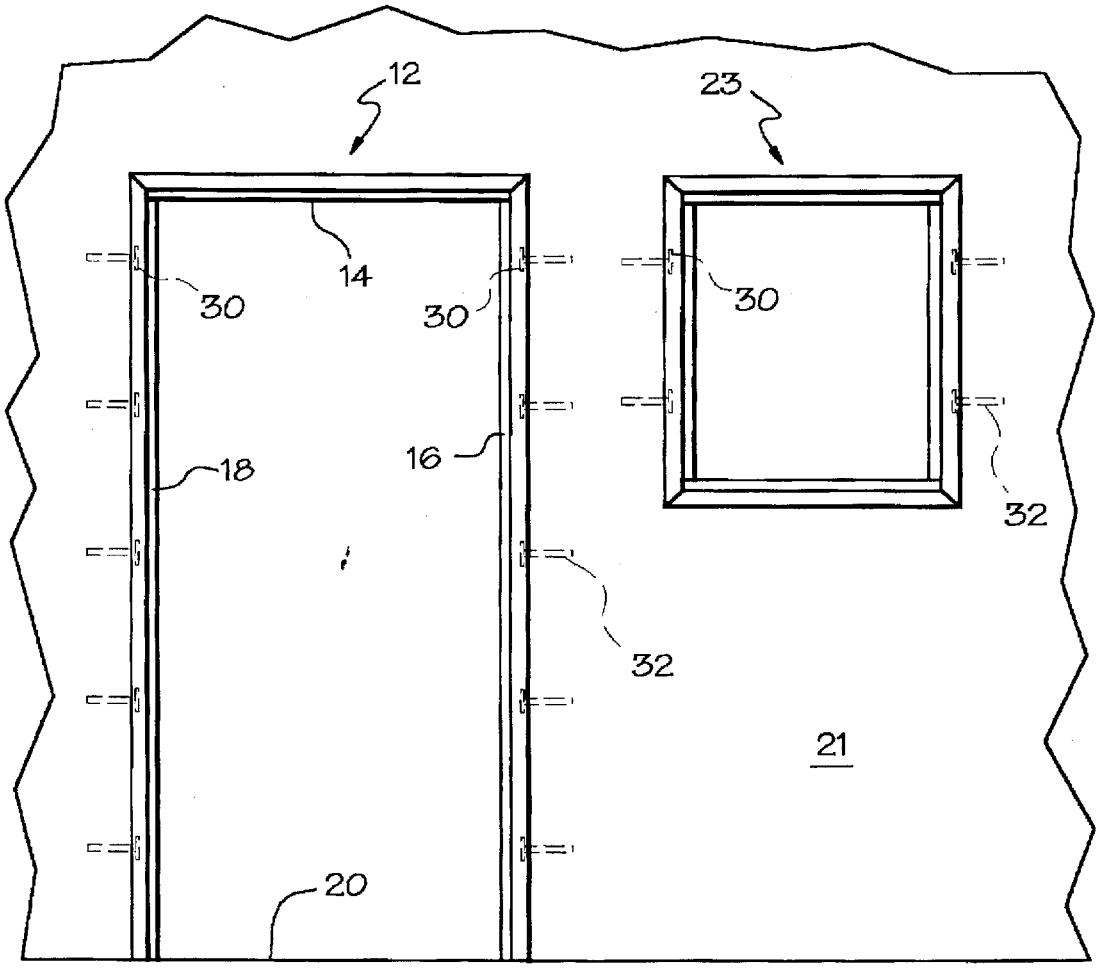
FIG. 1 is an elevational view illustrating an exemplary embodiment of an anchor and metal door frame and assembly thereof mounted in a masonry wall in accordance with the present invention.

FIG. 1 illustrates a metal door frame 12 having a header 14 which attaches to opposing first and second door jambs 16 and 18 respectively, which are typically hinge and strike jambs. The header and jambs are also referred to in this patent application as frame members of the frame 12. The metal door frame 12 is constructed from an assembly illustrated herein as having a pair of first and second door jambs 16 and 18 respectively, connected by the header 14 and resting on a floor 20 between typically masonry walls 21 that extend upward from the floor. The present invention was developed for a metal door frame 12 but may also be used for other types of metal frames such as window frames 23 or casings. The nomenclature used herein is well known in the industry and essentially described in greater detail in the reference "Nomenclature for Steel Doors and Steel Door Frames" published by the Steel Door Institute and approved by the American National Standards institute and is used herein as a standardized reference for all terms and nomenclature where applicable. The present invention includes a metal frame anchor 30 and a metal frame assembly including such an anchor, which provide the above listed advantages as compared to conventional types of these devices which are commonly used for securing a metal door or window frame to an adjacent wall structure, and which may be attached or fastened to wall anchor elements 32 which are at least partially buried or otherwise suitably secured in or to the masonry wall 21.

Referring in more detail to FIGS. 2 through 6, the metal frame anchor 30 has a generally rectangular base 34 and first and second prongs 36 and 38 respectively, which are bent upward and then over the base in opposite directions to form clips which open in opposite directions. The base 34 has at least one set of angularly cut opposite corners 40 and preferably the anchor includes a twisting element for turning the base about an axis perpendicular to the base and which is illustrated as a slot 42 in the base 34. The slot 42 is designed to be engaged by a flat edge tip of a screwdriver 44 so as to allow the base 34 to be rotated. The base 34 is preferably formed from steel plate wherein the prongs 36 and 38 are also formed from the steel plate.

Figure 2:
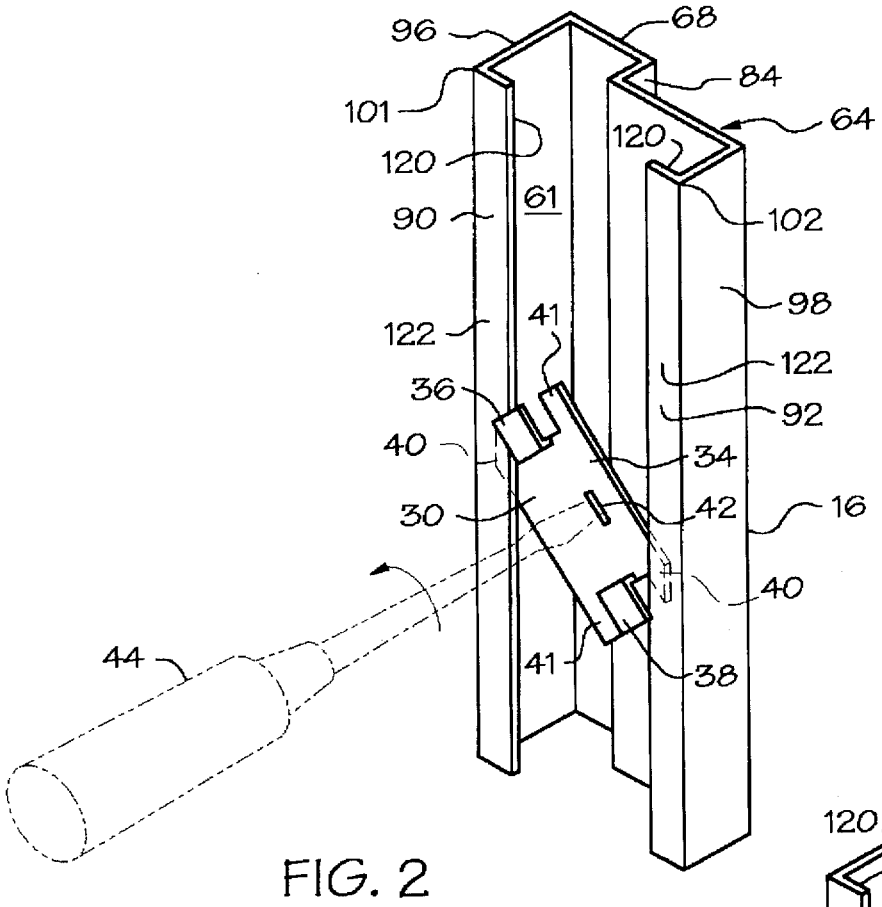
FIGS. 2 and 3 are perspective views illustrating an exemplary embodiment of an anchor and metal door frame and assembly thereof in accordance with the present invention.
Figure 3:
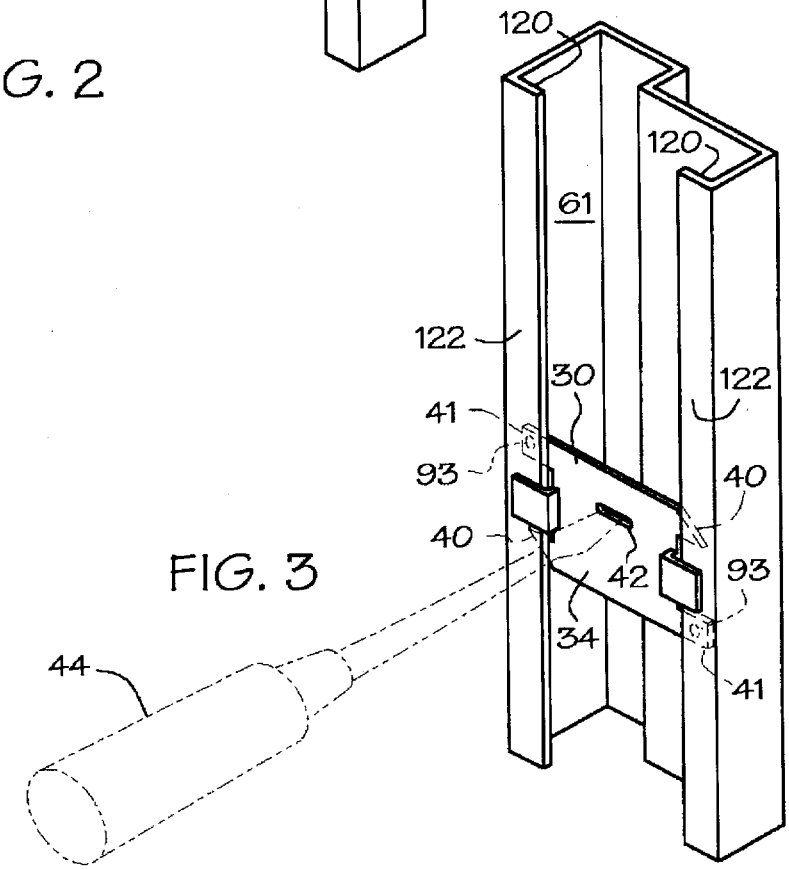
Figure 4:
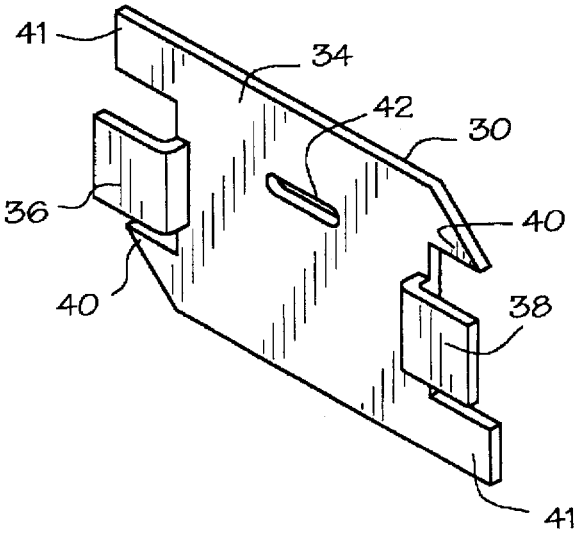
FIG. 4 is a perspective view of the anchor in FIG. 2.
Figure 5:
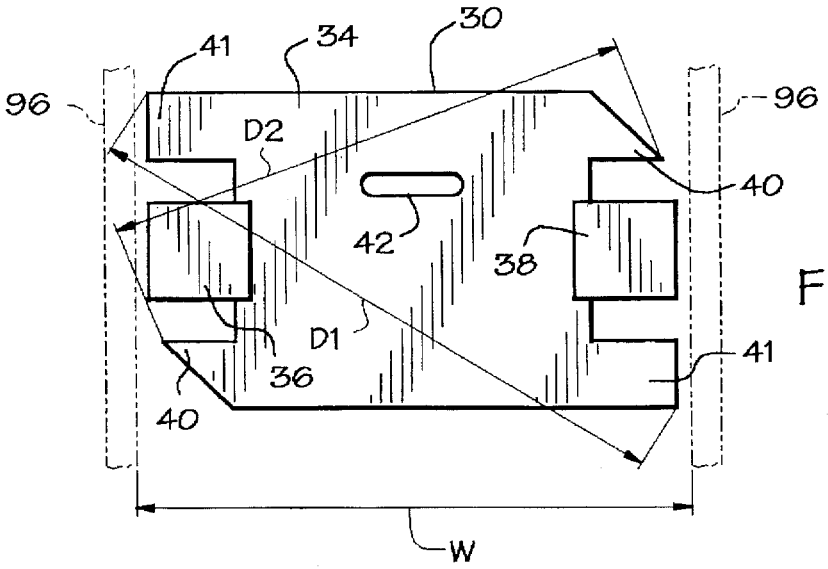
FIG. 5 is a front elevational view of the anchor in FIG. 3.
Figure 6:
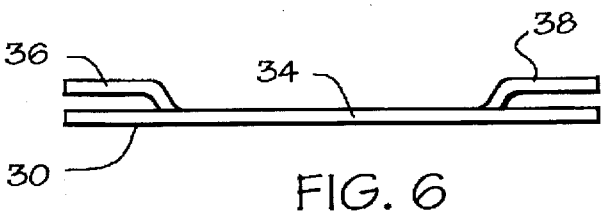
FIG. 6 is a side elevational view of the anchor in FIG. 3.

The metal frame anchor 30 is illustrated in the exemplary embodiment of the invention in FIGS. 2 and 3 as being used in conjunction with a single rabbet door jamb 16, however the invention may be used for double rabbet or other type of jambs as well. The metal frame element in the form of jamb 16 encompasses an inner space 61 and has a rabbet 64, spaced apart from and generally parallel to a soffit 68, and a stop 84 extends substantially perpendicular to and between the rabbet and the soffit. A left face 96 extends perpendicularly from the soffit 68 to a left back end 101 of the left face. The right face 98 extends perpendicularly from the from the soffit 68 to a right back end 102 of the right face. A left backbend 90 extends from the left back end 101, perpendicular to left face 96, and towards the right face 98, so as to be generally parallel to the rabbet 64 and the soffit 68 and borders the inner space 61. A right backbend 92 extends from the right back end 102, perpendicular to the right face 98, and towards the left face 96, so as to be generally parallel to the rabbet 64 and the soffit 68 and borders the inner space 61.

The metal frame anchor 30 is mounted or clipped onto the right and left backbends 92 and 90 and can be rotated so as to have the prongs 36 and 38 fully engage the right and left backbends. The angularly cut opposite corners 40 allow placement of the base 34 inside of the frame element so that the base contacts inside surfaces 120 of the backbends 92 and 90 and the prongs 36 and 38 contact outside surfaces 122 of the backbends to which the anchor is clipped. The anchor 30 can be slid along the frame 12 with the anchor clipped to the backbends 92 and 90 allowing the anchor to be easily positioned. The base 34 may be fastened to the backbends 90 and 92, such as having the base welded or, more particularly, tack welded to the backbends indicated by tack weld marks 93 in FIG. 3. The angularly cut opposite corners 40 are important because it allows these corners to rotate past the right and left faces 98 and 96 respectively as opposite uncut squared corners 41 to engage the backbends 90 and 92 and contact their respective inside surfaces 120. Uncut opposite corners 41 are preferably sized to have a maximum first diameter D1 between them which is larger than a width W between the right and left faces 98 and 96 respectively while the angularly cut opposite corners 40 have a maximum second diameter D2 between them which is smaller than width W so as to permit the angularly cut opposite corners 40 to rotate past the faces.

Figure 7:
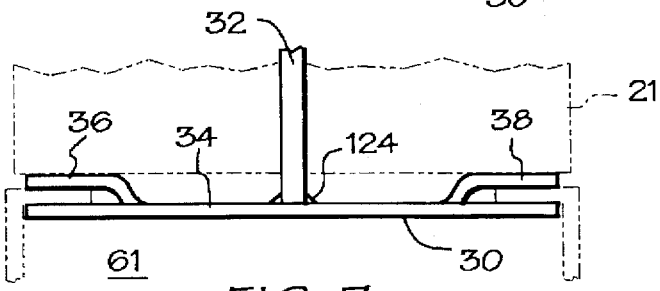
FIG. 7 is a cross-sectional view taken through 7—7 in FIG. 1.

This maximizes contact between the base 34 and the inside surfaces 120 of the backbends 90 and 92 thus providing strong fastening between the anchor and the frame and the anchor and the wall 21 when the base 34 is fastened to it such as illustrated in FIG. 7 showing one fastening embodiment contemplated by the present invention in which the anchor 30 is fastened to the masonry wall 21 by welding, indicated by welds 124, the wall anchor elements 32 to the base 34 of the anchor 30.

While the preferred embodiment of the present invention has been described fully in order to explain its principles. It is understood that various modifications or alterations may be made to the preferred embodiment without departing from the scope of the invention as set forth in the appended claims.

I claim:

1. A metal frame anchor comprising;

a generally rectangular base, two prongs bent upward and then over said base in opposite directions to form clips which open in said opposite directions, and said base having at least one set of angularly cut opposite corners.

2. A metal frame anchor as claimed in claim 1 further comprising a twisting element for turning said base about an axis perpendicular to said base.

3. A metal frame anchor as claimed in claim 2 wherein said twisting element is a slot in said base.

4. A metal frame anchor as claimed in claim 3 wherein said base is formed from a steel plate.

5. A metal frame anchor as claimed in claim 4 wherein said prongs are formed from said steel plate.

6. A metal frame assembly comprising;

a bent sheet metal frame element encompassing an inner space and having a soffit spaced apart from and generally parallel to a rabbet and a stop extending substantially perpendicular to and between said rabbet and said soffit;

said soffit and said rabbet supported by two faces extending generally perpendicular from and away from said rabbet and said soffit to back ends of said faces;

backbends extending perpendicularly inward from said back ends of said faces so as to be generally parallel to said rabbet and soffit and bordering said inner space;

a slidably insertable metal frame anchor disposed in said frame element;

said anchor comprising;

a generally rectangular base positioned on inside surfaces of said backbends, two prongs bent upward and then over said base in opposite directions to form clips which open in said opposite directions and which are positioned on outside surfaces of said backbends to which said anchor is clipped, and said base having at least one set of angularly cut opposite corners.

7. A metal frame assembly as claimed in claim 6 wherein said base further comprises a twisting element for turning said base about an axis perpendicular to said base.

8. A metal frame assembly as claimed in claim 7 wherein said twisting element is a slot in said base.

9. A metal frame assembly as claimed in claim 8 wherein said base is formed from a steel plate.

10. A metal frame assembly as claimed in claim 9 wherein said prongs are formed from said steel plate.

11. A metal frame assembly as claimed in claim 10 further comprising a wall fastener to secure the metal frame assembly to an adjacent wall wherein said fastener is attached to said base.

12. A metal frame assembly as claimed in claim 11 wherein said base is fastened to said backbends.

13. A metal frame assembly as claimed in claim 12 wherein said base is welded to said backbends.

* * * * *